US005950282A

United States Patent [19]

Pinto

[11] Patent Number: 5,950,282

[45] Date of Patent: Sep. 14, 1999

[54] TEXTILE CHUTE FEED

[76] Inventor: Akiva Pinto, P.O. Box 1100-171, Gastonia, N.C. 28053-1100

[21] Appl. No.: 09/166,301

[22] Filed: Oct. 5, 1998

[51] Int. Cl.[6] ..... D01B 1/00

[52] U.S. Cl. ..... 19/97.5; 19/105

[58] Field of Search ..... 19/97.5, 97, 92, 19/105, 204, 205, 90, 65 A, 225

[56] References Cited

U.S. PATENT DOCUMENTS

| | | | |
|---|---|---|---|
| 3,579,744 | 5/1971 | Menzies, Jr. | 19/105 |
| 4,404,710 | 9/1983 | Wood | 19/105 |
| 4,520,530 | 6/1985 | Pinto | 19/105 |
| 4,586,218 | 5/1986 | Pinto | 19/105 |
| 4,657,444 | 4/1987 | Pinto | 19/105 |
| 4,661,025 | 4/1987 | Pinto et al. | 406/70 |
| 4,682,388 | 7/1987 | Pinto | 19/105 |
| 4,694,538 | 9/1987 | Pinto et al. | 19/105 |
| 4,734,957 | 4/1988 | Lenzen | 19/105 |
| 4,769,873 | 9/1988 | Pinto | 19/105 |
| 4,864,693 | 9/1989 | Pinto et al. | 19/105 |
| 4,968,188 | 11/1990 | Lucassen | 406/70 |
| 5,016,324 | 5/1991 | Konig | 19/105 |
| 5,022,122 | 6/1991 | Clement | 19/225 |
| 5,586,365 | 12/1996 | Leifeld et al. | 19/105 |
| 5,623,749 | 4/1997 | Leifeld et al. | 19/105 |

FOREIGN PATENT DOCUMENTS

| | | | |
|---|---|---|---|
| 3328358 C2 | 2/1985 | Germany | D01G 23/04 |
| 3734140 A1 | 4/1989 | Germany | D01G 23/04 |
| 4434251 A1 | 3/1996 | Germany | D01G 15/40 |

*Primary Examiner*—Michael A. Neas
*Assistant Examiner*—Gary L. Welch
*Attorney, Agent, or Firm*—Henry S. Jaudon; Cort Flint

[57] ABSTRACT

A chute feed assembly for opening and moving fibers through a chute delivery system into an infeed chute for an opening station. The chute feed assembly includes a beater for opening the fibers which is drivable in a selected of two directions. The beater delivers the opened fibers into a fiber batt forming chute where they are formed into a fiber batt which is then delivered to further processing. The infeed air flow is assisted by providing non-friction chute surfaces to allow even fiber flow throughout the chute. Also, the air flows of densified air controlled across the fiber batt forming channel to provide for even fiber distribution of selected density. The assembly provides for all drive motors to be mounted outside the interior of the chute feed assembly reducing heat build-up within the chute feed assembly.

36 Claims, 4 Drawing Sheets

TEXTILE CHUTE FEED

BACKGROUND OF THE INVENTION

This invention relates to a fiber feeding system or a chute feed for opening, moving and forming fibers into a fiber batt for delivery to further processing systems. The chute feed is of the type which utilizes vertical and horizontal chutes to find and evenly distribute the fibers into an infeed chute. Non-friction inner chute surfaces assist in even and unobstructed movement of the fibers into the opening section. The batt forming section receives the opened fibers, forms a fiber batt and delivers the fiber batt to further processing systems. Controlled distribution and velocity of the densifying air is maintained throughout.

Chute feeding systems are well known in the industry. U.S. Pat. No. 4,968,188 discloses a known chute structure for feeding and distributing fibers into an infeed chute. U.S. Pat. No. 5,586,365 discloses an opening section associated with a batt forming chute and air stream densifying systems. U.S. Pat. No. 4,694,538 and German Publication No. 3328358 disclose batt forming chute structure to include a shaker wall and control. None of the cited references teach the fiber feeding system of the invention.

The instant invention has for its object a chute feed which operates with great efficiency with substantially all types and lengths of fibers.

Another object of the invention is a chute feed which does not cause unnecessary heat build up.

Another object of the invention is a chute feed with reduced resistance to fiber flow through the various chutes.

Another object of the invention is a chute feed which maintains even fiber distribution in the infeed chute.

Another object of the invention is a chute feed with an adjustable air flow across the forming chute.

Another object of the invention is a chute feed in which a beater is operable in two directions dependent upon fiber characteristics.

Another object of the invention is a chute feed in which the forming channel contains adjustable air migration channels.

Another object of the invention is a chute feed system having a plurality of controllable fans.

Another object of the invention is a chute feed system in which the batt forming chute has an adjustable air migration system.

SUMMARY OF THE INVENTION

The invention is directed to a chute feed for feeding fibers to form a fiber batt and for delivering the fiber batt to a further processing system. The feed includes a rectangular shaped infeed chute, an opening station, a rectangular shaped forming chute, and a delivery section.

A feed roll positioned in the discharge opening of the infeed chute forming a discharge chute. The feed roll is driven in a first direction.

The opening station includes a housing having a first opening which is connected with the discharge opening of the infeed chute and a second opening which is connected with the forming chute. A circular beater is mounted in the housing adjacent the feed roll. The outer circumference of the beater and an inner surface of the housing form a pair of delivery channels which extend from the first opening to the second opening. The delivery channels are shaped to be larger adjacent the second opening than they are adjacent the first opening.

A drive motor is provided to rotably driving the beater roll in a selected direction. A control is provided for selectively causing the motor to drive the beater roll in first and second directions. The beater direction of motion is determined depended upon the structural characteristics of the fibers being fed.

The infeed chute is rectangularly configured and extends substantially vertically from the delivery roll. The lower portion of the infeed chute is formed of lightweight material having an inner surface with raised dimples. The dimpled inner surface is coated with a non-friction coating material or the forming material is non-friction. There are adjustable horizontal wall sections in an upper section of the infeed chute. These wall sections form an adjustable throat which controls the rate of fiber flow into the lower portion of the infeed chute. The horizontal wall sections include at least one reed member which allows transport air to exit the infeed chute.

The chute feed includes a feed system for distributing a fiber flock evenly across the infeed chute. This feed system includes a circular feed duct which is arranged along a first plane and is connected with a fiber supply. A rectangular hood, which is arranged along a second plane below the first plane is formed with an open lower bottom connected with and extending across the infeed chute and an open end directed toward the feed duct. A rectangular connecting duct interconnects the feed duct with the open end of the hood. The connecting duct has a lower surface extending along a single plane and an upper surface extending along first and second planes. First and second side walls interconnect the upper and lower surfaces.

A fiber laden air flow is passed through the feed duct, the connecting duct and the hood. The upper surface of the connecting duct acts to engage and deflect downwardly a portion of the fibers during passage into and across the hood. This causes the fibers of the fiber laden air flow to be evenly distributed across the infeed chute.

The hood includes an upper surface which extends along the first and second planes. That portion of the upper surface of the hood extending along the first plane, about ⅓ of the upper surface, connects with the upper surface of the connecting duct extending along the same first plane. The portion of the upper surface of the hood extending along the first plane also engages and deflects downwardly a portion of the fibers along passage across the hood.

The connecting duct includes a fiber retention bin which is arranged below the lower surface of the connecting duct. A rectangular panel, which forms a portion of the lower surface, is located above the retention bin. A drive motor is connected with the retractable panel and is operative to move the retractable panel between positions directing the fiber laden air flow into the rectangular hood or the fiber retention bin.

The infeed chute includes first and second sensors connected with the motor. The first sensor is operative to actuate the drive motor to position the panel in position to direct the fiber laden air flow into the rectangular hood when the fibers in the infeed chute are below a selected level. The second sensor is operative to actuate the motor to move the panel into position to direct the fiber laden air flow into the fiber retention bin when the fibers in the infeed chute are above a selected level.

The chute feed is about 3 meters in width and includes an enclosed cabinet which houses a linearly extending rectangular fiber batt forming chute.

An opening section also housed within the housing acts to open and deliver fibers into the fiber batt forming chute. The opening section includes a housing having an inner wall, a rotating beater, an inlet opening, and an outlet opening. The beater and the inner wall of the housing form delivery channels connecting through the outlet opening with the upper end of the fiber batt forming chute.

A densifying air supply is located within the cabinet and provides a flow of densified air. An air delivery channel, arranged above the upper end of the fiber batt forming chute, receives and delivers the flow of densifying air against fibers delivered from a selected of the delivery channels and moves them into the fiber batt forming channel. A baffle is arranged across the air delivery channel for adjustably controlling the volume of air flow through the air delivery channel. The baffle includes a plurality of linearly arranged segments adjustably positioned across the width of the air delivery channel. Each segment is mounted for vertical adjustment so that the flow may be selectively increased or decreased across the width of the channel by positioning the segments to increase or decrease selected areas of the delivery channel. The densifying air is supplied by a plurality of fans connected with individual air delivery conduits which are arranged across said air delivery channel. A control is connected with each of the fans. The controls are operative to selectively vary the speed of each fan which selectively varies the flow of densified air across the air delivery channel.

The fiber batt forming chute includes a fiber batt forming section which compacts the fibers into a fiber batt. A discharge opening cooperates with delivery rolls to move the formed fiber batt from the fiber batt forming chute onto additional processing systems. The fiber batt forming chute includes front and back walls with the back wall having a pivotally mounted rocker plate. An oscillating drive is connected with the rocker plate for reciprocating the rocker plate about a pivot at one end thereof. The inner surfaces of the fiber batt forming chute are coated with a low friction material. These surfaces may be dimpled.

The back wall is formed with plurality of upwardly directed slanted transverse slots. These slots allow air of the flow of densified air to migrate from the fiber batt forming chute into the housing where it is re-circulated through the fan system as the flow of densified air. The back wall includes an air discharge reed which also allows the air of the densified air flow to migrate from the fiber batt forming chute. The reed is located above the slots. There are a plurality of air chambers formed on an outer side of the rear wall which communicate with the reed. Each of the air chambers has an adjustable opening which allows selected migration of the air through the reed. The air chambers also communicate with the slots.

The fan system comprises a plurality of fans and air conduits arranged across the cabinet. There are controls connected with each fan so that the volume of the flow of densified air delivered may be varied across the width of the open end.

The various areas of the feed system are driven by individual electric motors. These motors are all located outside the cabinet reducing the level of heat build up therein.

DESCRIPTION OF THE DRAWINGS

The invention will be more readily understood from a reading of the following specification and by reference to the accompanying drawings forming a part thereof, wherein an example of the invention is shown and wherein.

DETAILED DESCRIPTION

Figure 1:
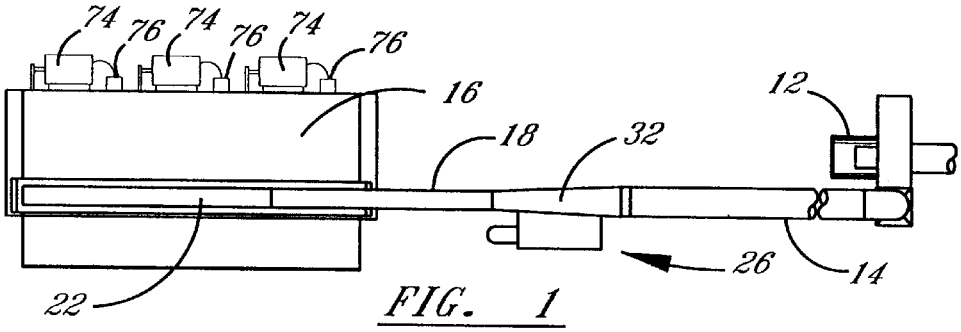
FIG. 1 is a top schematic view of the chute feed system of the invention.
Figure 2:
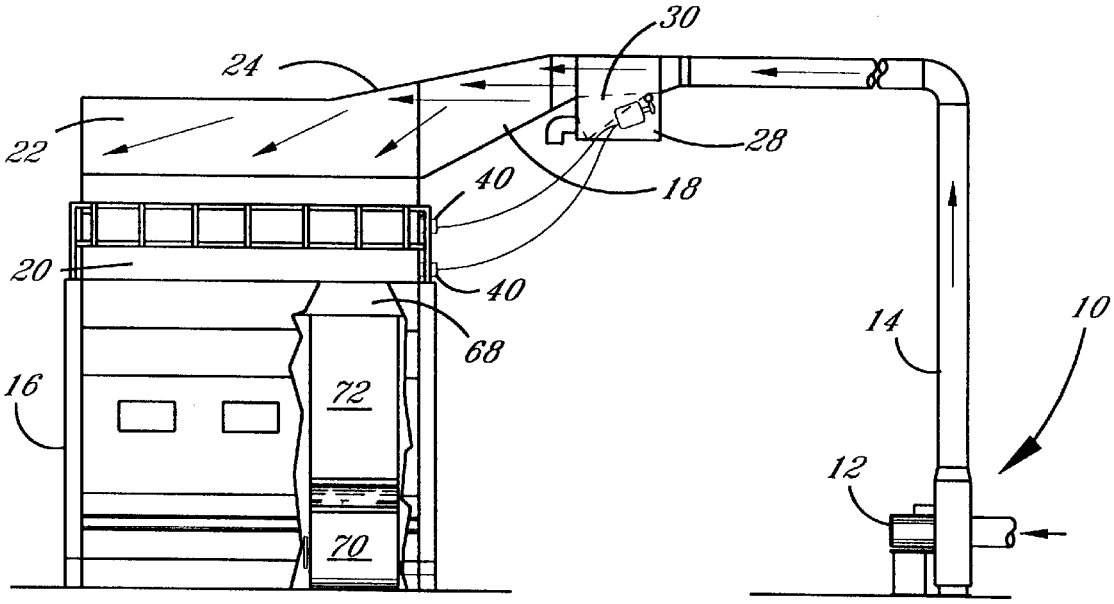
FIG. 2 is a side view of FIG. 1.
Figure 3:
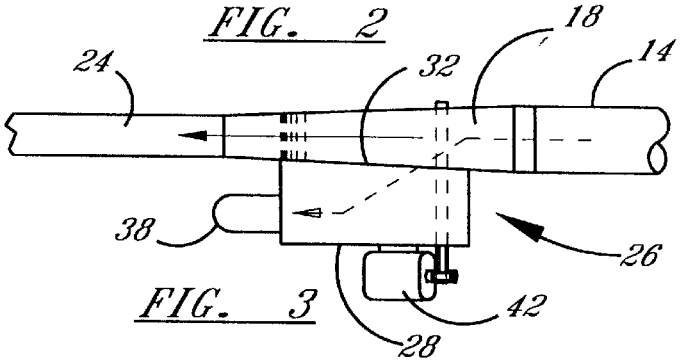
FIG. 3 is a top sectional view of a feed interrupt and strange arrangement of the chute feed system.

The chute feed assembly of the invention is generally shown in FIGS. 1 and 2. The chute feed assembly consists of a supply 10 driven by motor 12 which receives fibers and delivers them through circular feed duct 14 first substantially vertically and then horizontally toward cabinet 16. The horizontal section of feed duct 14 connects at its end with a rectangular shaped connective duct 18 which has its upper and lower surfaces extending first along a horizontal plane and then along a diagonal plane. Connecting duct has a cross-section which measures about 11500 $M^2$ while the cross-section of feed duct 14 is about 49,062 $mm^2$. These sizes may change between larger or smaller, however, the ratio between the ducts should stay substantially the same.

The upper portion of cabinet 16 mounts infeed chute 20 across its width. The upper end of infeed chute 20 mounts hood 22 which is generally rectangular in shape and includes closed sides, a top, an end wall, and an open lower area which is received over the upper end of the infeed chute. A second end is open and connects with connecting duct 18. A section 24 of the top portion of hood 22 is arranged along a diagonal plane which aligns with the plane of the top portion of connecting duct 18.

Air and air suspended fibers are moved through feed duct 14 at an air speed of about 10 meters per second. As the air suspended fibers move into connecting duct 18, a portion of the fibers along the upper extremity of the air stream strike and are deflected downwardly by the upper surface of the connecting duct. As the air stream and fibers move into the inner area of hood 22, upper surface 24 also serves to deflect most of the fibers downwardly. The action of the upper surfaces of connecting duct 18 and hood 22 cause the fibers to fall out of the air stream to be distributed evenly across the width of infeed chute 20.

Arranged in connecting duct 18 is a fiber retention assembly 26 which comprises a housing 28 carrying a pivoting panel 30 controlled by motor 42 between an upper position, indicated in FIG. 2, in which it forms a section of the lower surface of connecting duct 18 through housing 28. The second position for panel 30 is a lowered position shown best in FIG. 4. An inner wall 32, of a screen material, forms a side of connecting duct 18 through housing 28. Wall 32 extends completely down to and connects with the lower surface of housing 28.

A fiber storage bin 34 is formed in the area of housing 28 located beneath the upper position of panel 30. A forward wall 36, which comprises a screen, is contoured to follow the end of panel 30 as it moves between upper and lower positions. An exhaust duct 38 connects with housing 28 opposite forward wall 36.

Figure 4:
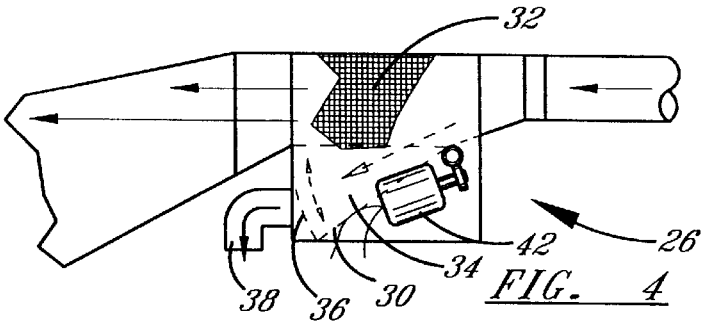
FIG. 4 is a side view of FIG. 3.

It is noted that fiber storage bin 34 extends across connecting duct 18 as does panel 30. Therefore, when panel 30 is in its raised position it separates duct 38 from the air flow passing through connecting duct 18 which allows the air flow carrying the suspended fibers to pass on into hood 22. When panel 30 is moved into its lowered position as shown in FIG. 4, the air flow and suspended fibers are directed downward as the air passes both through screen 32 and through the opening created by the downward movement of panel 30 as it is drawn out through screen 36 and duct 38. The fibers are collected in bin 34.

A pair of sensors 40, which are secured with infeed chute 20, control motor 42 between positions.

The fiber retention assembly 26 is provided to insure that infeed chute 20 is not overfilled to a degree as to become clogged. A first of sensors 40 detects when the level of fibers in chute 20 reaches an upper limit and activates motor 42 to move panel 30 to its lower position. The air now passes out through duct 38 and the fibers are collected in bin 34. A second of sensors 40 activates motor 42 to return panel 30 to its upper position reinstating the flow of air and fibers into hood 22 upon the fiber supply reaching a selected lower limit.

It is noted that panel 30, when moved from its lowered position to its upper position, returns the fibers collected in bin 34 into the air stream thereby providing an instant fiber supply for start-up.

Turning now to FIGS. 5–8, the infeed chute is described in detail. Infeedl chute 20 is formed generally rectangular with its upper end connecting with hood 22. The infeed chute includes an adjustable throat 44 formed across its side walls at an intermediate area thereof. Throat 44 includes a pair of panels 46 at least one of which is adjustably connected for inward and outward movement relative to the inner surfaces of chute 20 for controlling the fiber flow. At least one of panels 46 is formed as a reed which allows air from the stream to migrate out.

The lower end of infeed chute 20 is connected with and passes through the upper end of cabinet 16. Feed roll 48 forms with the end of infeed chute 20 and a discharge opening 50. Feed roll 48 is covered with the usual teeth about its outer surface which engage the fibers and move them through opening 50.

Figure 7:
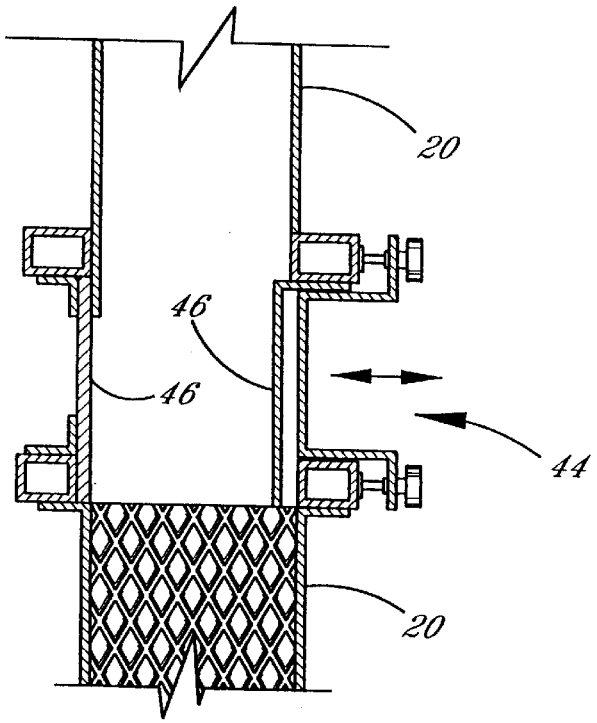
FIG. 7 is a sectional cutaway end view of the feed chute.
Figure 8:
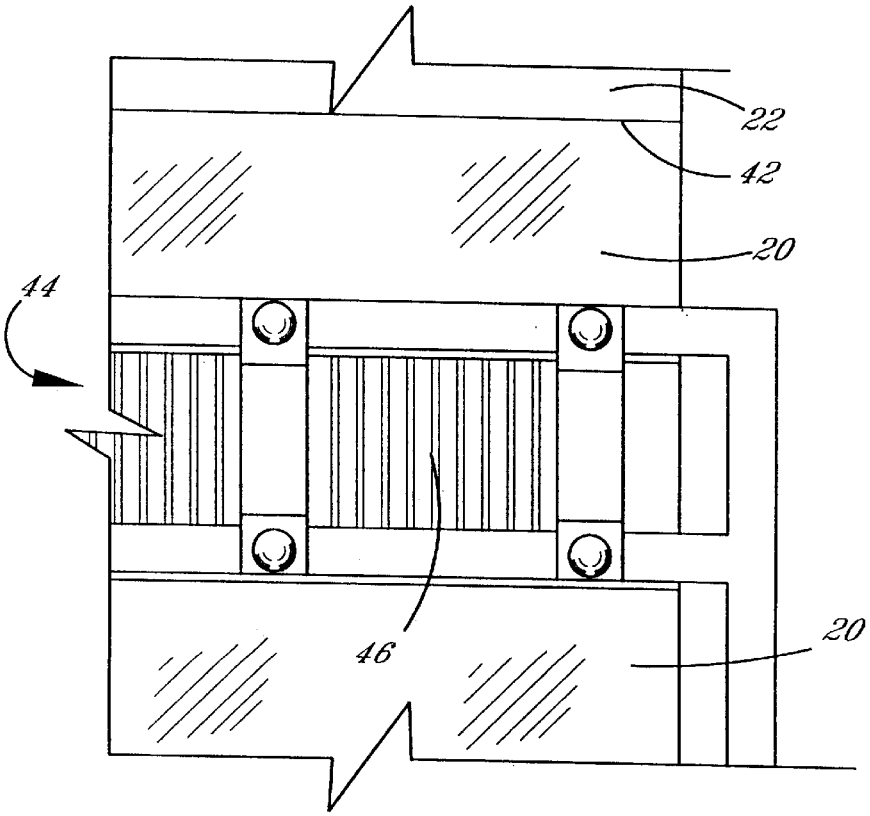
FIG. 8 is a sectional side view of the feed chute of FIG. 7.

The inner surface of feed chute 20, or at least the lower half of feed chute 20, is formed with raised dimples which could be diamond shaped as shown in FIG. 7. These raised dimples bring about improved air flow which prevents fibers from clinging with the walls of the chute. Also, the dimpled inner surface is coated with or formed of a non-friction material which further assist fiber flow.

Housing 56 connects with discharge opening 50. A beater 54 is positioned in housing 56 and is driven by motor 52 in either direction as indicated by the arrows. Feed roll 48, also driven by motor 52, engages the fibers and moves them through opening 50 into engagement with beater 54. The outer circumference of beater is covered with wire teeth which engage and remove the fibers from feed roll 40 and opening 50 and expel the opened fibers into channel 58 or 60 where they are carried out second through exit opening 62.

A switch 64' actuates motor 52 which through transmission 64 allows selective control of the direction in which beater 54 is driven. Transmission 64 also allows the relative speed of feed roll 48 and beater 54 to be controlled to desired relative speeds. Feed roll 48 and beater 54 are of any known construction and forms no part of the instant invention.

Figure 6:
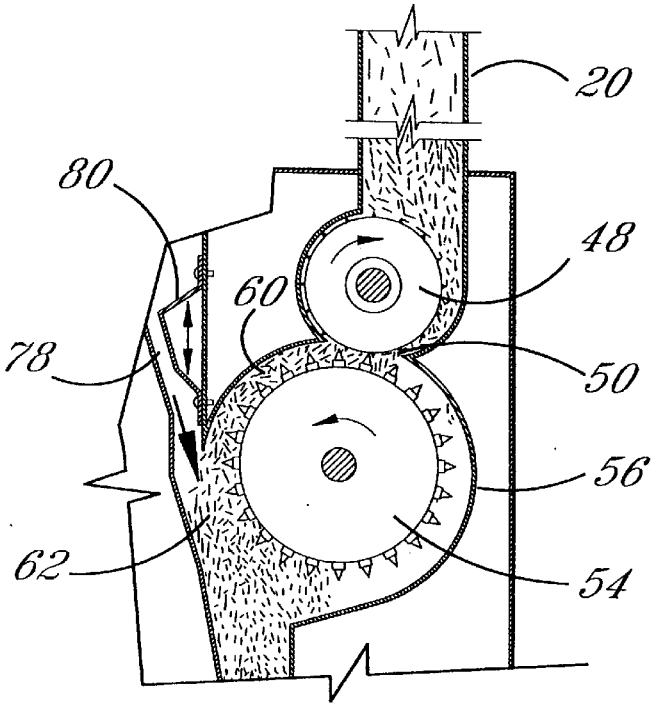
FIG. 6 is a sectional view of FIG. 5 showing the beater moving in the opposite direction.

Feed roll 48 is always driven in the clockwise direction. Beater 54 is normally driven in the clockwise direction which moves the fibers move through channel 58 when short and reclaimed fibers are being processed. For long and virgin fibers, it has been found that more desirable results are obtained with the beater moving in the counterclockwise direction which moves the fibers through channel 60 as shown in FIG. 6.

Channel 58 begins at opening 50 and progressively increases in size until it merges with opening 62. Channel 60, although slightly shorter is similarly constructed. The fibers are delivered from either channel 58 or 60 through opening 62 into the upper end of batt forming chute 66.

An air chamber 68 is formed beneath the upper surface of cabinet 16 and extends completely across the cabinet. At least three circulating fans 70 are located across the lower surface of cabinet 16 and are connected with air chamber 68 by conduits 72. Each fan 70 is driven by an electric motor 74. A control 76 is associated with each fan motor 74 and is capable of controlling the speed of that motor. This allows selected volumes of air to be delivered to air chamber 68 across the width of cabinet 16.

The forward lower end of air chamber 68 connects with a wedge shaped air channel 78. Air channel 78, which extends across the width of cabinet 16, connects with the open upper end of batt forming chute 66.

Positioned in channel 78 is baffe 80 which is adjustably secured with the end wall 82 of air chamber 68. By selectively positioning the baffle vertically along wall 82 the size of channel 78 is varied, thus selectively controlling the volume of densified air passing into the upper end of batt forming chute 66. Baffle 80 may be in segments so that it may be variably positioned across the width of channel 78 thereby creating variable air flow across the width of the channel. Control 76 may also be interconnected with positioning members for baffe 80. This allows baffle 80 and fans 74 to be controlled synchronously in accordance with the batt profile requirements.

Figure 5:
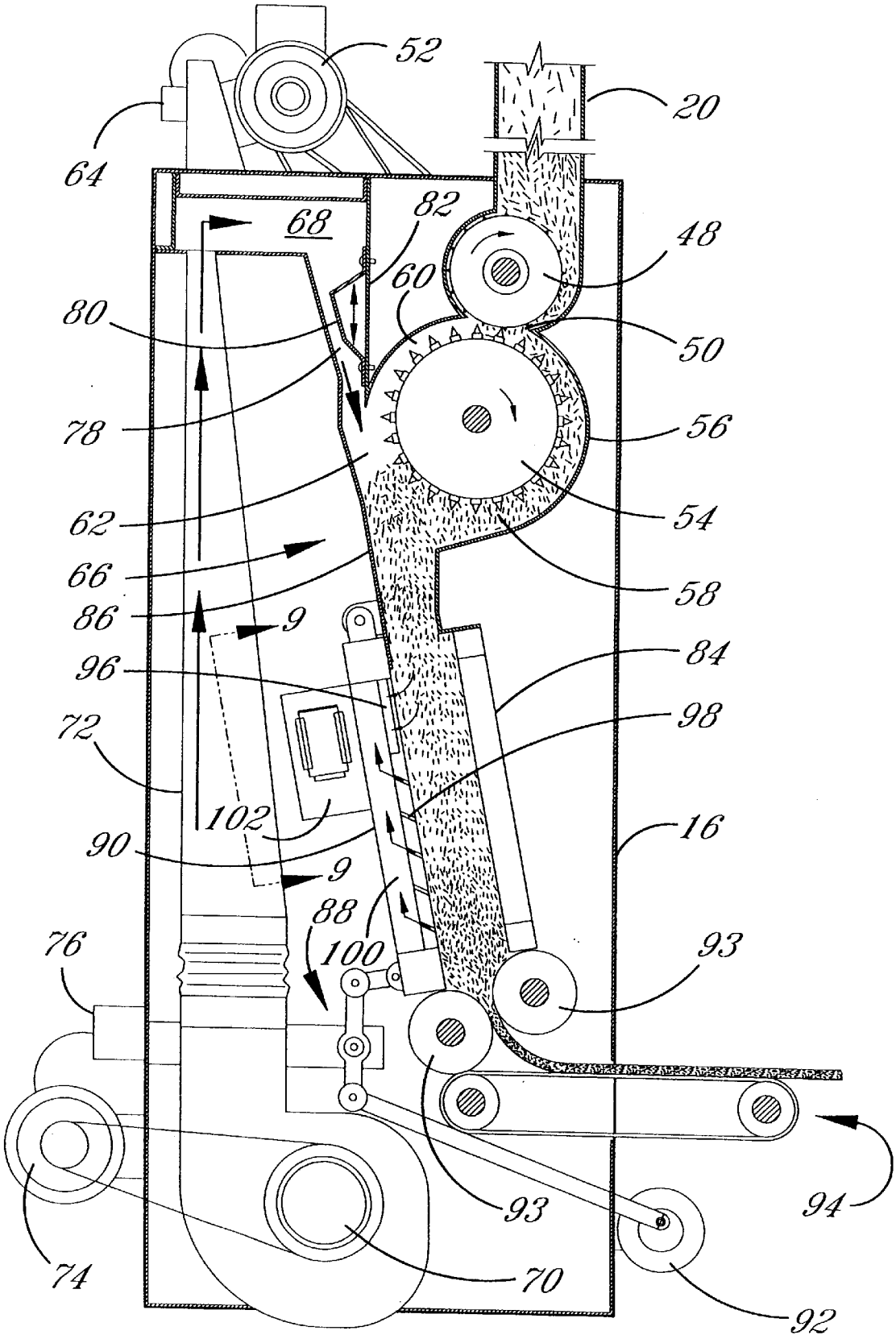
FIG. 5 is a cutaway end view of the chamber containing the feed chute, the opening housing with the beater moving in a first direction and the batt forming chute.

Channel 78 is located above opening 62 which causes the flow of densified air to be moving opposite the direction of movement of the fibers through exit opening 62 as processed in FIG. 5 and with the direction of fiber movement as process in FIG. 6.

Batt forming channel consists of a pair of side walls, not shown, connected with front wall 84. Front wall 84 connects with housing 56 at the end of lower delivery channel 58. Front wall 84 and the end walls may be formed with dimpled inner surfaces of nonfriction material.

Rear wall 86 extends behind opening 62 and merges with the rear wall 86 of channel 78. A rocker plate 90 is pivotally mounted at the lower end of rear wall 86. A usual drive mechanism 88, is connected with rocker plate 90 at its lower end and is driven by motor 92 to cause rocker plate 90 to move in the usual manner. Compression rolls 93 are mounted at the lower end of batt forming chute 66. Compression rolls receive and compress the formed fiber batt as it emerges from the batt forming chute and is delivered to conveyor 94 for delivery to further processing systems. Motor 92 may also drive rolls 93 and conveyor 94 through known drives.

Rocker plate 90 is formed with a reed 96 adjacent is upper end. Below reed 96 are formed a plurality of upwardly slanted slits 98 which extend completely across the width of the batt forming chute.

Figure 9:
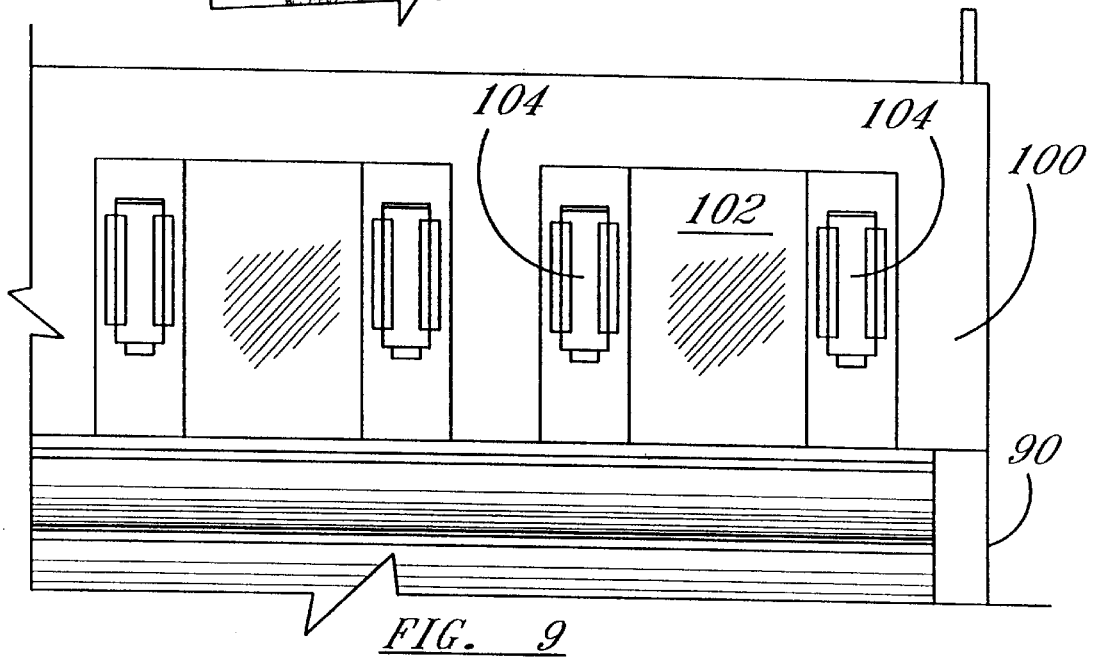
FIG. 9 is a sectional side view of the outer side of the rocker plate assembly; and, FIG. 10 is a sectional top view of FIG. 9.
Figure 10:
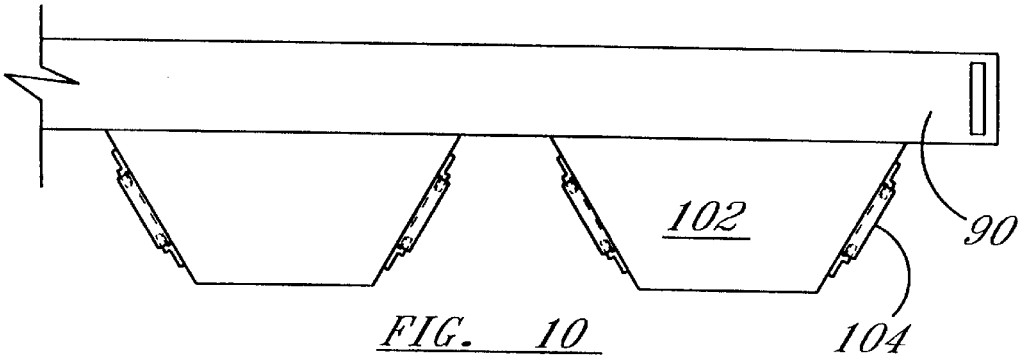

Reed 96 and slits 98 open into chamber 100 formed on the rear side of rocker plate 90. Chamber 100 has a plurality compartments 102 arranged across its upper end as best shown in FIGS. 9 and 10. Each compartment is formed with a pair of openings and associated closures 104. Closures 104 may be positioned by drive units controlled by control 76. Control 76 is therefore capable of controlling the air flow through baffe 80, conduits 72, and compartments 102 simultaneously.

Reed 96 and slits 98 allow densified air coming from air chamber 68 to migrate out of batt forming chute 66 as the fibers become compressed during movement toward compression rolls 92. The rate of migration of the densified air passing through rocker plate 90 and into chamber 100 and further into the interior of cabinet 16 is controlled by the position of closures 104.

Once in cabinet 16, the air is recaptured by fans 70 and re-circulated through the system.

In operation, the fibers are delivered into the supply chute 20 as earlier described. As they pass down supply chute 20, feed roll 48 engages and delivers them through opening 50 into engagement with beater 54. Beater 54 rotating in a selected direction opens and moves the fibers through delivery channel 58 or 60 to second opening 62. Here the fibers are propelled into batt forming channel 66 and are engaged by densified air passing downward through channel 78. It is noted that the air flow through channel 78 is opposite the flow of fibers traveling into batt forming channel 66 through channel 58 as shown in FIG. 6. As the densified air urges the fibers toward compression rolls 93 it begins to migrate out of the batt forming channel through reed 96 and slits 98. The fibers are urged through compression rolls 93 and delivered onto conveyor 94 for delivery to further processing apparatus.

It is noted that drive motors 12, 42, 52, 74, and 92 are all located outside the chute structure. This is because compressed air carrying fibers generates heat. By locating all of the drive motors outside of the closure, the heat which they generate remains outside and does not add to the heat already in the system.

While a preferred embodiment of the invention has been described using specific terms, such description is for illustrative purposes only, and it is to be understood that changes and variations may be made without departing from the spirit or scope of the following claims.

What is claimed is:

1. A chute feed for feeding fibers to form a fiber batt and for delivering said fiber batt to further processing, said chute feed having an infeed chute, an opening station, a forming chute, and a delivery section comprising:

a discharge opening at a first end of said infeed chute, a feed roll positioned in said discharge opening forming a discharge chute, a drive motor driving said feed roll in a first direction;

said opening station including a housing having a first opening connecting with said first end of said infeed chute and a second opening connecting with said forming chute, a beater, having an outer circumference, mounted in said housing adjacent said feed roll, said beater circumference and an inner surface of said housing forming a pair of delivery channels extending from said first opening to said second opening, each of said delivery channels being larger adjacent said second opening than adjacent said first opening;

a drive motor rotably driving said beater roll and a control for selectively causing said motor to drive said beater roll in first and second directions; whereby, fibers drawn from said infeed chute by said feed roll, driven in said first direction, are engaged and drawn into a delivery channel by said beater driven in a selected of said first and second directions, for opening and delivery of said fibers to said forming section, said beater direction of motion being depended upon structural characteristics of said fibers.

2. The chute feed of claim 1 wherein said beater is approximately 350 millimeters in diameter.

3. The chute feed of claim 1 wherein said first direction of rotation of said beater is clockwise, said first direction of rotation of said beater being optimum for short and reclaimed fibers.

4. The chute feed of claim 1 wherein said second direction of rotation of said beater is counterclockwise, said second direction of rotation being optimum for long and virgin fibers.

5. The chute feed of claim 1 wherein said infeed chute is rectangularly configured and extends upwardly from said delivery roll.

6. The chute feed of claim 5 wherein at least a lower portion of said infeed chute is formed of lightweight material having a raised dimpled non-friction inner surface.

7. The chute feed of claim 6 wherein said lightweight material is metal and said non-friction inner surface is coated onto said metal.

8. The chute feed of claim 5 including adjustable horizontal wall sections in an upper section of said infeed chute, said wall sections forming an adjustable throat which controls the rate of fiber flow into the lower portion of said infeed chute.

9. The chute feed of claim 8 wherein said horizontal wall sections include at least one reed member which allow transport air to exit said infeed chute.

10. The chute feed of claim 1 wherein the distance between said inner surface and said beater circumference gradually and uniformly increases between said first opening and said second opening.

11. A feed system for distributing a fiber flock evenly across an infeed chute of an opening station comprising:

a circular feed duct arranged along a substantially horizontal first plane and connected with a fiber supply;

a rectangular hood, arranged along a second plane substantially parallel with and below said first plane, having an open lower bottom connected with and extending across said infeed chute and an open end directed toward said feed duct;

a rectangular connecting duct laterally offset from said hood and extending diagonally to interconnect said feed duct with said open end of said hood, said connecting duct having a lower surface and an upper surface and first and second side walls interconnecting said upper and lower surfaces;

means producing a fiber laden air flow through said feed duct, said connecting duct and said hood;

said upper surface of said connecting duct acting to engage and deflect downwardly a portion of said fibers prior to and during passage thereof into and across said hood; whereby, said fibers of said fiber laden air flow are cause to be evenly distributed across said infeed chute.

12. The system of claim 11 wherein said feed duct has a cross-section of about 49062 $mm^2$.

13. The system of claim 11 wherein said connecting duct has a cross-section of about 11500 $mm^2$.

14. The system of claim 11 wherein said hood has a cross-section of about 86250 $mm^2$.

15. The system of claim 11 wherein said hood includes an upper surface comprised of first and second sections, said first section extending along the plane of said upper surface of said connecting duct, said first section of said upper surface portion acting to engage and deflect downwardly additional portions of said fibers during passage into said hood.

16. The system of claim 15 wherein said hood upper surface portion extending along said first plane comprises about ⅓ of said hood upper surface length.

17. The system of claim 11 wherein said connecting duct includes a fiber retention bin arranged below said lower surface;

a rectangular panel forming a portion of said lower surface, said retractable panel being located above said retention bin;

a drive motor connected with said retractable panel, said drive motor being operative to move said retractable panel between positions directing said fiber laden air flow into said rectangular hood and said fiber retention bin.

18. The system of claim 17 wherein said infeed chute includes first and second sensors connected with said motor, said first sensor being operative to actuate said drive motor into position said panel to direct said fiber laden air flow into said rectangular hood when said fibers in said fiber chute are below a selected level and said second sensor being operative to actuate said motor to move said panel into position to direct said fiber laden air flow into said fiber retention bin when said fibers in said fiber chute are above a selected level.

19. A chute feed assembly for forming fiber batts of about 3 meters in width comprising:

an enclosed cabinet;

a linearly extending rectangular fiber batt forming chute located within said cabinet having an open upper end;

an opening section located within said cabinet for opening and delivering fibers into said fiber batt forming chute, said opening section including a housing having an inner wall, a rotating beater and an inlet opening, said beater forming with said inner wall at least one delivery channel connecting with said upper end of said fiber batt forming chute;

an air delivery channel arranged above said upper end of said fiber batt forming chute for delivering a flow of said densifying air against fibers delivered from said delivery channel for moving said fibers into said fiber batt forming channel;

at least one fan providing and delivering said flow of densifying air across the width of said air delivery channel and a control for controlling said at least one fan;

a baffle arranged across a vertical wall of and widthwise of said air delivery channel and a baffle mounting adjustably securing said baffle to said wall within said air delivery channel wherein;

said air flowing through said air delivery channel and engaging said fibers passed from said opening section and into said fiber batt forming channel may be of selected volumes of air flow widthwise of said fiber batt forming channel as determined by at least one of said fan control and baffle mounting.

20. The chute feed of claim 19 wherein said baffle includes a plurality of linearly arranged segments adjustably positioned across the width of said air delivery channel, means mounting each of said segments for vertical adjustment whereby said air flow may be selectively increased or decreased across said width by positioning said segments to increase or decrease the area of said delivery channel.

21. The chute feed of claim 20 wherein said at least one fan comprises a plurality of fans connected with individual air delivery conduits, said air delivery conduits being arranged across said air delivery channel.

22. The chute feed of claim 21 including a control connected with each of said fans and said baffle segments, said control being operative to selectively vary said fan speed and said baffle segment position to selectively vary said flow of densified air across said air delivery channel.

23. The chute feed of claim 19 wherein said fiber batt forming chute includes a fiber batt forming section which compacts said fibers into a fiber batt, said batt forming section includes a discharge opening and delivery rolls for moving said formed fiber batt from said fiber batt forming chute onto additional processing.

24. The chute feed of claim 23 wherein said fiber batt forming chute includes front and back walls, said back wall including a rocker plate, said rocker plate being pivotally mounted at its upper end; and, an oscillating drive connected with said rocker plate for pivotally reciprocating said rocker plate.

25. The chute feed of claim 23 wherein said fiber batt forming chute includes a pair of end walls, a front wall and a rear wall;

said end walls and said front wall having dimpled inner surfaces of low friction material.

26. The chute feed of claim 25 wherein said front wall and side wall inner surfaces are dimpled.

27. The chute feed of claim 19 wherein said flow of densified air is opposite the direction of rotation of said beater.

28. A chute feed assembly for forming fiber batts comprising:

a cabinet;

an opening section for receiving and opening fibers from a delivery chute located within said cabinet;

a fiber batt forming chute within and extending across said cabinet having a rectangular cross-section, said batt forming chute having an open upper end for receiving opened fibers from said opening section and an open lower end for emitting said fibers formed into a fiber batt;

a fan system within said cabinet for providing a circulating flow of densifying air within said cabinet;

an air delivery channel located within said cabinet above said upper end of said forming chute for delivering said flow of densified air directly into said open upper end of said forming chute and onto said opened fibers during delivery therein;

said fiber batt forming chute having a rear wall formed with a plurality of upwardly directed slanted transverse slots opening into a chamber having an outlet within said cabinet, said slots allowing air of said air flow of densified air to migrate from said fiber batt forming chute into said chamber; whereby, said air is recaptured by said fan system and re-circulated through said chute feed assembly as said flow of densified air.

29. The chute feed assembly of claim 28 including a feed roll for delivering fibers to said opening section, a delivery roll for removing said fiber batt from said fiber batt forming chute, and a rocker drive for rocking said rear wall.

30. The chute feed of claim 29 including electric motors mounted outside said cabinet for driving each of said feed roll, said opening section, said fan system, said rocker drive and said delivery roll.

31. The chute feed of claim 28 wherein said rear wall includes an air discharge reed for allowing said densified air to migrate from said fiber batt forming chute, said reed being located above said slots.

32. The chute feed of claim 31 including a plurality of air compartments formed on an outer side of said rear wall said air compartments connecting with and forming said outlet of said chamber, each of said air compartments having an adjustable opening; whereby, migration of said air though said slots is selectively controlled.

33. The chute feed of claim 32 wherein said control controls said adjustable opening and said fan speed.

34. A chute feed assembly for forming fiber batts comprising:

a cabinet;

an opening section for receiving and opening fibers from a delivery chute located within said cabinet;

a fiber batt forming chute within and extending across said cabinet having a rectangular cross-section, said batt forming chute having an open upper end for receiving opened fibers from said opening section and an open lower end for emitting said fibers formed into a fiber batt;

a fan system within said cabinet for providing a circulating flow of densifying air within said cabinet;

an air delivery within said cabinet channel for delivering said flow of densified air onto said opened fibers during delivery into said open upper end of said fiber batt forming chute;

said fiber batt forming chute having a rear wall formed with a plurality of upwardly directed slanted transverse slots, an air discharge reed above said slots, said slots and said reed allowing air of said air flow of densified air to migrate from said fiber batt forming chute into said cabinet; whereby, said air is recaptured by said fan system and re-circulated through said chute feed assembly as said flow of densified air.

35. The chute feed of claim 34 including air compartments, said air compartments communicating with said slots.

36. The chute feed of claim 34 wherein said fan system comprises a plurality of fans and air conduits arranged across said housing; and, a control connected with each fan of said plurality of fans; whereby, the volume of said flow of said densified air generated by said fans and delivered to said fiber bett forming chute may be varied between said fans.

* * * * *